US008906842B2

(12) United States Patent
Tantawy et al.

(10) Patent No.: US 8,906,842 B2
(45) **Date of Patent: *Dec. 9, 2014**

(54) SPRAY-DRIED DETERGENT POWDER

(71) Applicant: The Proctor & Gamble Company, Cincinnati, OH (US)

(72) Inventors: Hossam Hassan Tantawy, Morpeth (GB); Andres Arturo Martinez-Guzman, Newcastle upon Tyne (GB); Andre-Brian Greenaway Patton, Co Durham (GB); Adam Porter, Whitley Bay (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/898,543

(22) Filed: May 21, 2013

(65) Prior Publication Data

US 2013/0324452 A1 Dec. 5, 2013

(30) Foreign Application Priority Data

Jun. 1, 2012 (EP) ..... 12170464

(51) Int. Cl.

| | |
|---|---|
| ***C11D 11/02*** | (2006.01) |
| ***C11D 3/37*** | (2006.01) |
| ***C11D 17/06*** | (2006.01) |
| ***C11D 3/04*** | (2006.01) |
| ***C11D 11/00*** | (2006.01) |

(52) U.S. Cl.

CPC ..... *C11D 11/02* (2013.01); *C11D 3/046* (2013.01); *C11D 11/0082* (2013.01); *C11D 17/06* (2013.01)

USPC ..... 510/443; 510/452; 510/276; 510/475

(58) Field of Classification Search

CPC ..... C11D 17/06; C11D 11/02; C11D 11/082; C11D 3/046

USPC ..... 510/443, 452, 276, 475

See application file for complete search history.

(56) References Cited

U.S. PATENT DOCUMENTS

| | | | | |
|---|---|---|---|---|
| 4,783,281 | A * | 11/1988 | Bishop et al. | 510/443 |
| 4,820,441 | A * | 4/1989 | Evans et al. | 510/452 |
| 4,900,466 | A * | 2/1990 | Atkinson et al. | 510/443 |
| 5,009,804 | A * | 4/1991 | Clayton et al. | 510/299 |
| 5,225,100 | A * | 7/1993 | Fry et al. | 510/298 |
| 6,143,711 | A | 11/2000 | Del Greco et al. | |
| 6,191,095 | B1 * | 2/2001 | Emery et al. | 510/438 |
| 6,221,831 | B1 * | 4/2001 | Emery et al. | 510/438 |
| 6,673,766 | B1 * | 1/2004 | Hartshorn et al. | 510/446 |
| 6,908,895 | B2 | 6/2005 | Bakker et al. | |
| 7,446,085 | B2 | 11/2008 | Imaizumi et al. | |
| 7,605,116 | B2 * | 10/2009 | Brooker et al. | 510/351 |
| 8,802,615 | B2 * | 8/2014 | Martinez-Guzman et al. | 510/443 |
| 2001/0031719 | A1 * | 10/2001 | Bakker et al. | 510/446 |
| 2003/0203832 | A1 | 10/2003 | Boucher et al. | |
| 2006/0035802 | A1 * | 2/2006 | Brooker et al. | 510/445 |
| 2011/0146099 | A1 * | 6/2011 | Cardozo et al. | 34/339 |

FOREIGN PATENT DOCUMENTS

WO WO 2010/024468 A1 * 3/2010

OTHER PUBLICATIONS

PCT International Search Report, PCT/US2013/043267, dated Jul. 25, 2013, containing 9 pages.

* cited by examiner

*Primary Examiner* — Lorna M Douyon

(74) *Attorney, Agent, or Firm* — John T. Dipre; Steven W. Miller

(57) ABSTRACT

The present invention is a spray-dried powder comprising: (i) from 20 to 80 wt % of a first spray-dried particle comprising less than 5 wt % sulphate, anionic detersive surfactant and having a bulk density of from 300 g/l to 450 g/l: and (ii) from 20 to 80 wt % of a second spray-dried particle comprising at least 45 wt % sulphate, 0 wt % to 15 wt % anionic detersive surfactant, and having a bulk density of from 350 g/l to 700 g/l.

19 Claims, No Drawings

SPRAY-DRIED DETERGENT POWDER

FIELD OF THE INVENTION

The present invention relates to a spray-dried detergent powder and a process for making a spray-dried detergent powder.

BACKGROUND OF THE INVENTION

Particulate detergent compositions comprise detersive active ingredients. Often-times these detersive ingredients make the particles 'sticky'. This has the effect of making the particles stick together which negatively impacts the flowability of the granular composition and can affect the dissolution in the wash liquor. Therefore, a 'bulking agent' in the form of a separate particle or powder is often added to the granular composition to counteract the stickiness and maintain good flowability.

Bulking agents include, sulphates, carbonates, silicates, clays (such as bentonite clay), and zeolite. However, carbonates and silicates affect the pH of the wash liquor, making it alkaline and so affecting the cleaning performance of the detergent components. Zeolite is a detergent builder and so interacts with ions in the water that are the source of water hardness. Thus it forms residues of these complexes that deposit on fabrics. Clays result in fabric greying, fabric colour fading and residue deposition on the fabrics.

The most preferred bulking agent is sulphate, as this is pH neutral, and does not act as a builder. However, natural sulphate has a high bulk density so upon addition to water it rapidly sinks and forms a sediment at the bottom of the container. Consumers associate this sedimentation with 'poor cleaning' as they believe that the composition is not dissolving into the water and so 'not working'. Furthermore, in a fabric hand washing context, the slowly dissolving sediment makes the wash liquor feel 'gritty'. Consumers associate this with 'dirty wash water' and 'lack of cleaning'. In addition, as the sulphate sediments in the wash liquor, it can trap other detergent components and so affect the overall cleaning performance.

Thus, there is a need in the art for a granular laundry detergent composition that at least in part overcomes the above mentioned problems but still exhibits excellent flowability.

The Inventors have surprisingly found that a spray-dried powder comprising (i) from 20 to 80 wt % of a first spray-dried particle comprising less than 5 wt % sulphate, anionic detersive surfactant, and having a bulk density of from 300 g/l to 450 g/l: and (ii) from 20 to 80 wt % of a second spray-dried particle comprising at least 45 wt % sulphate, and having a bulk density of from 350 g/l to 700 g/l overcame this issue. It was further surprisingly found that providing the sulphate in a second particle according to the present invention improved the ability to formulate the sulphate into the spray-dried powder during manufacture.

SUMMARY OF THE INVENTION

A first aspect of the present invention is a spray-dried powder comprising:

(i) from 20 to 80 wt % of a first spray-dried particle comprising less than 5 wt % sulphate, anionic detersive surfactant, and having a bulk density of from 300 g/l to 450 g/l: and (ii) from 20 to 80 wt % of a second spray-dried particle comprising at least 45 wt % sulphate, and having a bulk density of from 350 g/l to 700 g/l.

A second aspect of the present invention is a process for making the spray-dried powder according to the first aspect.

DETAILED DESCRIPTION OF THE INVENTION

The Spray-Dried Powder

The spray dried powder of the present invention comprises (i) from 20 to 80 wt % of a first spray-dried particle comprising less than 5 wt % sulphate, anionic detersive surfactant, and having a bulk density of from 300 g/l to 450 g/l: and (ii) from 20 to 80 wt % of a second spray-dried particle comprising at least 45 wt % sulphate, and having a bulk density of from 350 g/l to 700 g/l.

The first particle can comprise from 50 wt % to 80 wt %, or even from 60 wt % to 80 wt % by weight of the spray-dried powder. Alternatively, the first particle can comprise from 20 wt % to 50 wt % by weight of the spray-dried powder. The second particle can comprise from 50 wt % to 80 wt %, or even from 60 wt % to 80 wt % by weight of the spray-dried powder. Alternatively, the second particle can comprise from 20 wt % to 50 wt % by weight of the spray-dried powder.

The spray-dried detergent powder is suitable for any detergent application, for example: laundry, including automatic washing machine laundering and hand laundering, and even bleach and laundry additives; hard surface cleaning; dish washing, especially automatic dish washing; carpet cleaning and freshening. However, highly preferably, the spray-dried detergent powder is a spray-dried laundry detergent powder.

The spray-dried detergent powder can be a fully formulated detergent product, such as a fully formulated laundry detergent product, or it can be combined with other particles to form a fully formulated detergent product, such as a fully formulated laundry detergent product. The spray-dried laundry detergent particles may be combined with other particles such as: enzyme particles; perfume particles including agglomerates or extrudates of perfume microcapsules, and perfume encapsulates such as starch encapsulated perfume accord particles; surfactant particles, such as non-ionic detersive surfactant particles including agglomerates or extrudates, anionic detersive surfactant particles including agglomerates and extrudates, and cationic detersive surfactant particles including agglomerates and extrudates; polymer particles including soil release polymer particles, cellulosic polymer particles; buffer particles including carbonate salt and/or silicate salt particles, preferably a particle comprising carbonate salt and silicate salt such as a sodium carbonate and sodium silicate co-particle, and particles and sodium bicarbonate; other spray-dried particles; fluorescent whitening particles; aesthetic particles such as coloured noodles or needles or lamellae particles; bleaching particles such as percarbonate particles, especially coated percarbonate particles, including carbonate and/or sulphate coated percarbonate, silicate coated percarbonate, borosilicate coated percarbonate, sodium perborate coated percarbonate; bleach catalyst particles, such as transition metal catalyst bleach particles, and imine bleach boosting particles; preformed peracid particles; hueing dye particles; and any mixture thereof.

It may also be especially preferred for the spray-dried detergent powder to comprise low levels, or even be essentially free, of builder. By essentially free of it is typically meant herein to mean: "comprises no deliberately added". In a preferred embodiment, the spray-dried detergent powder comprises no builder.

The spray-dried particle is typically flowable, typically having a cake strength of from 0 N to 20 N, preferably from 0 N to 15 N, more preferably from 0 N to 10 N, most preferably from 0 N to 5 N. The method to determine the cake strength is described in more detail elsewhere in the description.

The spray-dried detergent powder comprises a first spray-dried particle and a second spray-dried particle. By first and second spray-dried particles, we herein mean that the spray-dried detergent powder comprises two distinct particle types, the first spray-dried particle being formed independently of the second spray-dried particle. The first spray-dried particle has a different intra-particulate chemistry to that of the second spray-dried particle.

The spray-dried powder comprising the first and second spray-dried particles typically comprises from 0 wt % to 7 wt %, preferably from 0.5 wt % to 5 wt %, and preferably from 1 wt % to 2 wt % water.

First Spray-Dried Particle

The first spray-dried particle comprises less than 5 wt % sulphate, anionic detersive surfactant, and has a bulk density of from 300 g/l to 450 g/l.

The first spray-dried particle may comprise 0 to 5 wt %, preferably 1 to 5 wt % polymer, preferably 1.5 to 3 wt % polymer. Without wishing to be bound by theory, the presence of the polymer can act to decrease the 'stickiness' of the first particle. This has benefits on the flowability of the spray-dried powder. The polymer in the first particle can be selected from a polycarboxylate homopolymer or a polycarboxylate copolymer, preferably the polymer is selected from polyacrylate homopolymer or acrylic acid/maleic acid copolymer. Suitable polymers are described in more detail below.

The first particle may comprise at least 5 wt %, or at least 10 wt %, or at least 15 wt %, or at least 30 wt % anionic detersive surfactant. The first particle may comprise at most 50 wt %, or at most 40 wt %, or at most 30 wt %, or at most 20 wt % anionic detersive surfactant. Suitable anionic detersive surfactants are described in more detail below. The anionic detersive surfactant can be alkyl benzene sulphonic acid or salt thereof, alkyl ethoxylated sulphate, or a mixture thereof. The anionic detersive surfactant can be a mixture of alkyl benzene sulphonic acid or salt thereof and alkyl ethoxylated sulphate.

The sulphate is described in more detail below.

The first particle may comprise from 0-20 wt % silicate, or 1-15 wt % silicate.

The first particle may comprise 0-50 wt % carbonate, or 10-40 wt % carbonate, or 15-40 wt % carbonate.

The first particle may comprise HEDP, brighteners or a mixture thereof. Brighteners are described in more detail below.

The first particle may have a mean particle size of between 350 and 500 μm, preferably 375-425 μm.

Second Spray-Dried Particle

The second spray-dried particle comprises at least 45 wt % sulphate and has a bulk density of from 350 g/l to 700 g/l.

The sulphate is described in more detail below. The second particle may comprise at least 55 wt %, or even 65 wt % or even 75 wt % sulphate. The second particle may comprise at most 99 wt % sulphate, or even 90 wt %, or even 85 wt % or even 80 wt % sulphate.

The second particle may comprise carbonate. If carbonate is present in the second particle, it may be present at a concentration of between 0 wt % and 30 wt %, or at most 20 wt %, or even at most 10 wt %. Carbonate may be present in the second particle at a concentration of at least 1 wt %, or even 2 wt %, or even 5 wt % or even 10 wt %, or even 15 wt %.

The second particle may comprise polymer, preferably 0-10 wt % polymer, or even 1 wt % to 8 wt % polymer. Suitable polymers are described in more detail below. The polymer in the second particle can be selected from a polycarboxylate homopolymer or a polycarboxylate copolymer, preferably the polymer is selected from polyacrylate homopolymer or acrylic acid/maleic acid copolymer.

The second particle may comprise from 0 to 15 wt %, or even from 1 to 12 wt %, or from 2 to 10 wt % anionic detersive surfactant. Suitable anionic detersive surfactants are described in more detail below. The anionic detersive surfactant in the second particle can be linear alkylbenzene sulfonate. Or the anionic detersive surfactant in the second particle can be alkyl ethoxylated sulphate The second particle may comprise from 0-10 wt % silicate, or even 1-10 wt % silicate. The second particle may have a mean particle size of between 350 and 500 μm, preferably 375-425 μm.

Without wishing to be bound by theory, the density of the second particle means that it floats in the wash liquor and exhibits reduced sedimentation. The density of the second particle is lower than traditionally used sulphate particles. This is achieved by injecting air into an aqueous slurry which is then spray-dried to produce the second particle. This results in 'air bubbles' in the particle. This increased porosity means that the particle has a higher surface area, and so the particle dissolves faster in the wash liquor. This faster dissolution and lower level of sedimentation means that the wash liquor does not have the same gritty feel as if traditional sulphate particles were used. However, the sulphate (second) particle still acts a bulking agent ensuring excellent flowbability of the powder composition.

The bulk density of the second particle can be from 350 g/l to 600 g/l, or from 400 g/l to 550 g/l.

Sulphate

The sulphate in the first spray-dried particle and independently in the second spray-dried particle can be any suitable sulphate.

Polymer

The polymer in the first particle and independently in the second particle can be any suitable polymer. The anionic detersive surfactant can be alkyl benzene sulphonic acid or salt thereof, alkyl ethoxylated sulphate, or a mixture thereof. Preferably, the anionic detersive surfactant is a mixture of alkyl benzene sulphonic acid or salt thereof and alkyl ethoxylated sulphate.

Suitable polymers include carboxylate polymers, such as polyacrylates, and acrylate/maleate co-polymers and other functionalized polymers such as styrene acrylates. Preferably, the carboxylate polymer is an acrylate/maleate copolymer having an average molecular weight of about 2,000 to about 100,000 and a ratio of acrylate to maleate segments of from about 30:1 to about 1:1.

One suitable polymer is an amphiphilic graft polymer (AGP). Suitable AGPs are obtainable by grafting a polyalkylene oxide of number average molecular weight from about 2,000 to about 100,000 with vinyl acetate, which may be partially saponified, in a weight ratio of polyalkylene oxide to vinyl acetate of about 1:0.2 to about 1:10. The vinyl acetate may, for example, be saponified to an extent of up to 15%. The polyalkylene oxide may contain units of ethylene oxide, propylene oxide and/or butylene oxide. Selected embodiments comprise ethylene oxide.

In some embodiments the polyalkylene oxide has a number average molecular weight of from about 4,000 to about 50,000, and the weight ratio of polyalkylene oxide to vinyl acetate is from about 1:0.5 to about 1:6. A material within this definition, based on polyethylene oxide of molecular weight 6,000 (equivalent to 136 ethylene oxide units), containing approximately 3 parts by weight of vinyl acetate units per 1 part by weight of polyethylene oxide, and having itself a molecular weight of about 24,000, is commercially available from BASF as Sokalan HP22.

Suitable AGPs may be present in the detergent composition at weight percentages of from about 0 to about 5%, preferably from about above 0% to about 4%, or from about 0.5% to about 2%. In some embodiments, the AGP is present at greater than about 1.5 wt %. The AGPs are found to provide excellent hydrophobic soil suspension even in the presence of cationic coacervating polymers.

Preferred AGPs are based on water-soluble polyalkylene oxides as a graft base and side chains formed by polymerization of a vinyl ester component. These polymers having an average of less than or equal to one graft site per 50 alkylene oxide units and mean molar masses (Mw) of from about 3000 to about 100,000.

Another suitable polymer is polyethylene oxide, preferably substituted or un-substituted.

Another suitable polymer is cellulosic polymer, preferably selected from alkyl cellulose, alkyl alkoxyalkyl cellulose, carboxylalkyl cellulose, alkyl carboxyalkyl, more preferably selected from carboxymethyl cellulose (CMC) including blocky CMC, methyl cellulose, methyl hydroxyethyl cellulose, methyl carboxymethyl cellulose, and mixtures thereof.

Other suitable polymers are soil release polymers. Suitable polymers include polyester soil release polymers. Other suitable polymers include terephthalate polymers, polyurethanes, and mixtures thereof. The soil release polymers, such as terephthalate and polyurethane polymers can be hydrophobically modified, for example to give additional benefits such as sudsing.

Other suitable polymers include polyamines, preferably polyethylene imine polymers, preferably having ethylene oxide and/or propylene oxide functionalized blocks Other suitable polymers include synthetic amino containing amphoteric/and/or zwitterionic polymers, such as those derived from hexamethylene diamine.

Another suitable polymer is a polymer that can be co-micellized by surfactants, such as the AGP described in more detail above.

Other suitable polymers include silicone, including amino-functionalised silicone.

Suitable polymers can include clay and soil removal/anti-redeposition agents being co-polymers comprising:

(i) from 50 to less than 98 wt % structural units derived from one or more monomers comprising carboxyl groups; (ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (I) and (II):

formula (I)

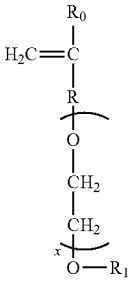

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

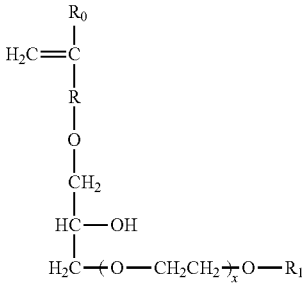

in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

Other suitable polymers include polysaccharide polymers such as celluloses, starches, lignins, hemicellulose, and mixtures thereof.

Other suitable polymers include cationic polymers, such as deposition aid polymers, such as cationically modified cellulose such as cationic hydroxy ethylene cellulose, cationic guar gum, cationic starch, cationic acrylamides and mixtures thereof.

Mixtures of any of the above described polymers can be used herein.

Anionic Detersive Surfactant

Suitable anionic detersive surfactants include sulphate and sulphonate detersive surfactants.

Preferred sulphonate detersive surfactants include alkyl benzene sulphonate, preferably $C_{1013}$ alkyl benzene sulphonate. Suitable alkyl benzene sulphonate (LAS) is obtainable, preferably obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable.

Preferred sulphate detersive surfactants include alkyl sulphate, preferably $C_{8-18}$ alkyl sulphate, or predominantly $C_{1-2}$ alkyl sulphate.

Another preferred sulphate detersive surfactant is alkyl alkoxylated sulphate, preferably alkyl ethoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 0.5 to 20, preferably from 0.5 to 10, preferably the alkyl alkoxylated sulphate is a $C_{8-18}$ alkyl ethoxylated sulphate having an average degree of ethoxylation of from 0.5 to 10, preferably from 0.5 to 7, more preferably from 0.5 to 5 and most preferably from 0.5 to 3.

The alkyl sulphate, alkyl alkoxylated sulphate and alkyl benzene sulphonates may be linear or branched, substituted or un-substituted.

Brightener

Suitable brighteners are stilbenes, such as brightener 15. Other suitable brighteners are hydrophobic brighteners, and brightener 49. The brightener may be in micronized particulate form, having a weight average particle size in the range of from 3 to 30 micrometers, or from 3 micrometers to 20 micrometers, or from 3 to 10 micrometers. The brightener can be alpha or beta crystalline form.

The detergent composition preferably comprises C.I. fluorescent brightener 260 in alpha-crystalline form having the following structure:

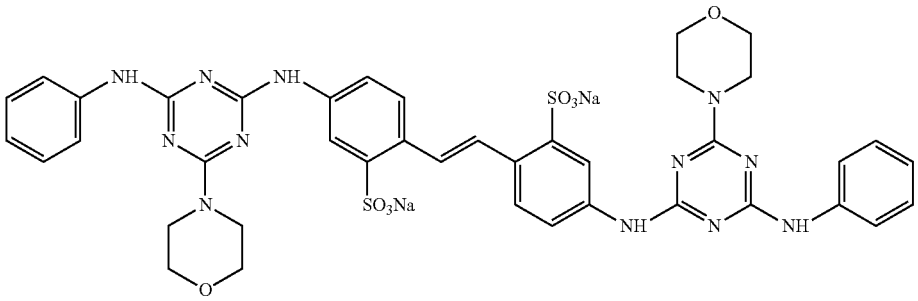

The C.I. fluorescent brightener 260 is preferably predominantly in alpha-crystalline form. Predominantly in alpha-crystalline form means that preferably at least 50 wt %, or at least 75 wt %, or even at least 90 wt %, or at least 99 wt %, or even substantially all, of the C.I. fluorescent brightener 260 is in alpha-crystalline form.

The brightener is typically in micronized particulate form, having a weight average primary particle size of from 3 to 30 micrometers, preferably from 3 micrometers to 20 micrometers, and most preferably from 3 to 10 micrometers.

The detergent composition may comprises C.I. fluorescent brightener 260 in beta-crystalline form, and preferably the weight ratio of: (i) C.I. fluorescent brightener 260 in alpha-crystalline form, to (ii) C.I. fluorescent brightener 260 in beta-crystalline form is at least 0.1, preferably at least 0.6.

BE680847 relates to a process for making C.I fluorescent brightener 260 in alpha-crystalline form.

Zeolite Builder

Suitable zeolite builder includes include zeolite A, zeolite P and zeolite MAP. Especially suitable is zeolite 4A.

Phosphate Builder

A typical phosphate builder is sodium tri-polyphosphate.

Silicate Salt

A suitable silicate salt is sodium silicate, preferably 1.6R and/or 2.0R sodium silicate.

Other Detergent Ingredients

The composition typically comprises other detergent ingredients. Suitable detergent ingredients include: transition metal catalysts; imine bleach boosters; enzymes such as amylases, carbohydrases, cellulases, laccases, lipases, bleaching enzymes such as oxidases and peroxidases, proteases, pectate lyases and mannanases; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; suds suppressing systems such as silicone based suds suppressors; brighteners; hueing agents; photobleach; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; soil dispersants and soil anti-redeposition aids such as alkoxylated polyamines and ethoxylated ethyleneimine polymers; anti-redeposition components such as polyesters and/or terephthalate polymers, polyethylene glycol including polyethylene glycol substituted with vinyl alcohol and/or vinyl acetate pendant groups; perfumes such as perfume microcapsules, polymer assisted perfume delivery systems including Schiff base perfume/polymer complexes, starch encapsulated perfume accords; soap rings; aesthetic particles including coloured noodles and/or needles; dyes; fillers such as sodium sulphate, although it may be preferred for the composition to be substantially free of fillers; carbonate salt including sodium carbonate and/or sodium bicarbonate; silicate salt such as sodium silicate, including 1.6R and 2.0R sodium silicate, or sodium metasilicate; co-polyesters of di-carboxylic acids and diols; cellulosic polymers such as methyl cellulose, carboxymethyl cellulose, hydroxyethoxycellulose, or other alkyl or alkylalkoxy cellulose, and hydrophobically modified cellulose; carboxylic acid and/or salts thereof, including citric acid and/or sodium citrate; and any combination thereof.

Method for Measuring Cake Strength

A smooth plastic cylinder of internal diameter 6.35 cm and length 15.9 cm is supported on a suitable base plate. A 0.65 cm hole is drilled through the cylinder with the centre of the hole being 9.2 cm from the end opposite the base plate.

A metal pin is inserted through the hole and a smooth plastic sleeve of internal diameter 6.35 cm and length 15.25 cm is placed around the inner cylinder such that the sleeve can move freely up and down the cylinder and comes to rest on the metal pin. The space inside the sleeve is then filled (without tapping or excessive vibration) with the spray-dried powder such that the spray-dried powder is level with the top of the sleeve. A lid is placed on top of the sleeve and a 5 kg weight placed on the lid. The pin is then pulled out and the spray-dried powder is allowed to compact for 2 minutes. After 2 minutes the weight is removed, the sleeve is lowered to expose the powder cake with the lid remaining on top of the powder.

A metal probe is then lowered at 54 cm/min such that it contacts the centre of the lid and breaks the cake. The maximum force required to break the cake is recorded and is the result of the test. A cake strength of 0 N refers to the situation where no cake is formed.

Spray-Drying Process

The process for making the spray-dried powder of the present invention comprises the steps of;

a) preparing a first aqueous slurry comprising anionic surfactant and water;

b) preparing a second aqueous slurry comprising sulphate and water;

c) spraying the first aqueous slurry through a first spray nozzle and the second aqueous slurry through a second spray nozzle into a spray-drying tower; and d) spray-drying the mixture to form the spray-dried powder.

Step (a): the first aqueous slurry can be formed by mixing in any suitable vessel, such as a mixer, in the standard manner. Suitable mixers include vertical mixers, slurry mixers, tank agitators, crutcher mixers and the like. The first aqueous slurry may comprise silicate, polymer, sulphate, carbonate or a mixture thereof;

Step (b): the second aqueous slurry can be formed by mixing in any suitable vessel, such as a mixer, in the standard manner. Suitable mixers include vertical mixers, slurry mixers, tank agitators, crutcher mixers and the like. The second aqueous slurry may comprise silicate, polymer, anionic detersive surfactant or a mixture thereof.

Step (c): the first aqueous slurry is transferred from the mixer, preferably through at least one pump, to a first spray nozzle. Typically, the first aqueous slurry is transferred in a pipe. The first aqueous slurry is typically transferred though an intermediate storage vessel such as a drop tank, for example when the process is semi-continuous. Alternatively, the process can be a continuous process, in which case no intermediate storage vessel is required. The first aqueous slurry is transferred through at least one pump, preferably at least two, or even at least three or more pumps, although one or two, preferably two pumps may be preferred. Typically, when two or more pumps are used, the first pump is a low pressure pump, such as a pump that is capable of generating a pressure of from $3\times10^5$ to $1\times10^6$ Pa, and the second pump is a high pressure pump, such as a pump that is capable of generating a pressure of from $2\times10^6$ to $1\times10^7$ Pa. Optionally, the first aqueous slurry is transferred through a disintegrator, such as disintegrators supplied by Hosakawa Micron. The disintegrator can be positioned before the pump, or after the pump. If two or more pumps are present, then the disintegrator can also be positioned between the pumps. Typically, the pumps, disintegrators, intermediate storage vessels, if present, are all in series configuration. However, some equipment may be in a parallel configuration. A suitable spray nozzle is a Spray Systems T4 Nozzle.

The first aqueous slurry may be made by firstly mixing water and if present, silicate, polymer, carbonate, sulphate, or a mixture thereof. This first aqueous slurry is then pumped along a pipe to the first spray nozzle and the anionic detersive surfactant is injected into the pipe before the first aqueous slurry is sprayed from the first spray nozzle. Preferably, the first aqueous slurry is passed through a first pump prior to addition of the anionic detersive surfactant and then passed through a second pump before passing to the first spray nozzle. A gas may be introduced between the first pump and the second pump. A gas, preferably air, may be pumped into the anionic detersive surfactant, preferably at a pressure of between 0.1 MPa and 2 MPa, prior to it being contacted with the first aqueous slurry. Alternatively, a gas can be injected directly into the slurry at any point before the spray nozzle, preferably between the first and second pumps. By 'nitrogen-rich gas' we herein mean a gas that comprises at least 50 wt % nitrogen. By 'air' we herein mean atmospheric air.

The second aqueous slurry is also transferred from the mixer, preferably through at least one pump, to a second spray nozzle in the same way as detailed above for the first aqueous slurry.

In a preferred embodiment, the second aqueous slurry is prepared by mixing the sulphate and the water and if present, the anionic surfactant, to form an aqueous premix, the aqueous premix is pumped through a pipe to the second spray nozzle, the silicate and polymer are independently injected into the pipe before the spray nozzle. The premix can be formed by mixing in any suitable vessel, such as a mixer, in the standard manner. Suitable mixers include vertical mixers, slurry mixers, tank agitators, crutcher mixers and the like.

The independent injection of the silicate and the polymer can be carried out in any position after the mixer and before the spray nozzle. However, preferably injection is carried out after the premix has been transferred through at least one pump, although injection can be carried out before the premix has been transferred through at least one pump. In a preferred embodiment, the premix is transferred through at least two pumps, and injection is carried out after the premix has been transferred through the first pump but before the premix enters the second pump.

A nitrogen-rich gas, preferably air, may be injected into the slurry at any point before the spray nozzle, preferably between the first and second pumps. Without wishing to be bound by theory injection of nitrogen-rich gas into the slurry introduces gas bubbles into the slurry. These remain in the slurry during spray-drying and so are captured in the spray-dried particles. This provides the particles with a lower bulk density. By 'nitrogen-rich gas' we herein mean a gas comprising at least 50 wt % nitrogen. By 'air' we herein mean atmospheric air.

Preferably, during step (c) the pipe carrying the first aqueous slurry and separately the pipe carrying the second aqueous slurry and premix are at a pressure between $3\times10^5$ and $1\times10^6$ Pa.

In step (c), it may be preferred that additionally sodium chloride is contacted to the first aqueous slurry, the second aqueous slurry, or both, after the mixer and before the spray nozzle.

The first aqueous slurry is sprayed through the first spray nozzle into a spray-drying tower, and the second aqueous slurry is independently sprayed through the second spray nozzle into the spray-drying tower. Preferably, the first and second aqueous slurries are independently at a temperature of from 60° C. to 130° C. when they are sprayed through the spray nozzles into a spray-drying tower. Suitable spray-drying towers are co-current or counter-current spray-drying towers. The slurries are typically sprayed at a pressure of from $3\times10^6$ Pa to $1\times10^7$ Pa.

Step (d): the slurries are spray-dried to form a spray-dried powder. Preferably, the exhaust air temperature is in the range of from 60° C. to 100° C.

Preferably when added to the aqueous slurry, the sulphate has a volume average particle size of from 10 micrometers to 50 micrometers, preferably from 20 micrometers, or from 30 micrometers, and preferably to 45 micrometers, or even to 42 micrometers. The volume average particle size of the sulphate can be determined by any conventional means, such as light scattering, for example using a sympatec particle size analyser. The particle size of the inorganic salt can be controlled (i.e. reduced) by any suitable means, such as dry grinding (e.g. using pin mills) or wet grinding (e.g. using colloid mill). Without wishing to be bound by theory, smaller particle size sulphate dissolves more efficiently into the aqueous slurry. It is believed this is due to the larger surface area of the sulphate particles. This improved efficiency of dissolution has the benefit that less sulphate sediments out of the slurry during the manufacturing process. Sedimentation can cause blockages in the apparatus and so negatively affect production. Furthermore, the smaller particle size of the sulphate in the resultant spray-dried particle has the benefit of further reducing the 'gritty' feel within the wash liquor.

Preferably, the first spray nozzle is at a position higher up the spray drying tower than the second nozzle. Without wishing to be bound by theory, the spray-drying tower is heated from the bottom. Hence the hottest air exists at the bottom of the tower, with cooler air nearer the top of the tower. By introducing the first slurry into the tower at a point higher up, the slurry droplets encounter cooler air. This reduces the likelihood of the first particle being overheated in the tower and so damaging the components of the first particle. The second particle which comprises large quantities of sulphate is more heat resistant, and so can be introduced at a point further down the tower where the hotter air exists.

EXAMPLES

A comparison was made between a spray-dried powder according to the present invention and a spray-dried powder outside of the scope of the present claims.

A first detergent powder A was prepared. An aqueous alkaline slurry composed of sodium sulphate, sodium carbonate, water, acrylate/maleate co-polymer and miscellaneous ingredients was prepared at 80° C. in a crutcher making vessel. The aqueous slurry was essentially free from zeolite builder and essentially free from phosphate builder. Alkyl benzene sulphonic acid (HLAS) and sodium hydroxide were added to the aqueous slurry and the slurry was pumped through a standard spray system pressure nozzle and atomized into a counter current spray drying tower at an air inlet temperature of 275° C. The atomized slurry was dried to produce a solid mixture, which was then cooled and sieved to remove oversize material (>1.8 mm) to form a spray-dried powder. The spray-dried powder had a bulk density of 470 g/l.

This spray-dried powder was blended, in a batch rotating mixer, with other ingredient to produce a composition comprising 57.91% spray-dried powder, 13% surfactant agglomerate and 20.45% sodium sulphate. Powder detergent A has a cake strength of 0 N as measured using the method described herein. The overall composition of the POWDER DETERGENT A is shown in Table 1.

TABLE 1

| Component | % w/w POWDER A |
|---|---|
| Sodium silicate salt | 5.7 |
| Linear alkyl benzene sulphonate | 14.5 |
| Acrylate/maleate copolymer | 1.6 |
| Zeolite | 2.7 |
| Sodium carbonate | 12.4 |
| Sodium sulphate | 56.8 |
| Water | 1.5 |
| Miscellaneous, such as dye, clay, perfume and enzymes | 2.7 |
| Total Parts | 100.00 |

A second detergent powder B was prepared comprising and 43 wt % of a first spray dried particle (bulk density: 300 g/l), and 56 wt % of a second spray-dried particle (bulk density: 380 g/l), blended in a batch rotating mixer, with 1% of sodium sulphate and other minor powder additives. The composition of the first dried particle is seen in Table 2 and the second spray-dried particle in Table 3.

TABLE 2

| Component | % w/w |
|---|---|
| Sodium silicate salt | 15.6 |
| Linear alkyl benzene sulphonate | 40.0 |
| Sodium carbonate | 38.5 |
| Water | 2.5 |
| Chelant | 3.4 |
| Total Parts | 100.0 |

TABLE 3

| Component | % w/w |
|---|---|
| Sodium silicate salt | 3.0 |
| Linear alkyl benzene sulphonate | 9.7 |
| Acrylate/maleate copolymer | 9.1 |
| Sodium sulphate | 77.2 |
| Water | 1.0 |
| Total Parts | 100.0 |

The first spray dried particle was manufactured via spray drying of an aqueous alkaline slurry composed of sodium carbonate, anionic surfactant and acrylate polymer. The slurry was prepared at 80° C. in a crutcher making vessel and the slurry was pumped through a standard spray system pressure nozzle and atomized into a counter current spray drying tower at an air inlet temperature of 275° C. The atomized slurry was dried to produce a solid mixture, which was then cooled and sieved to remove oversize material (>1.8 mm) to form a spray-dried powder.

The second spray dried particle was manufactured via spray drying of an aqueous slurry composed of sodium sulphate having a particle size of between 10 and 50 microns, water, anionic surfactant and acrylate/maleate co-polymer. The slurry was prepared in at 80° C. in a crutcher making vessel and the slurry was pumped through a standard spray system pressure nozzle and atomized into a counter current spray drying tower at an air inlet temperature of 275° C. The atomized slurry was dried to produce a solid mixture, which was then cooled and sieved to remove oversize material (>1.8 mm) to form a spray-dried powder.

Powder detergent B had a cake strength of 0 N as measured by the method described herein. The overall composition of the POWDER DETERGENT B is shown in Table 4.

TABLE 4

| Component | % w/w POWDER B |
|---|---|
| Sodium silicate salt | 5.6 |
| Linear alkyl benzene sulphonate | 15.8 |
| Acrylate/maleate copolymer | 7.1 |
| Zeolite | 1.0 |
| Sodium carbonate | 8.7 |
| Sodium sulphate | 57.7 |
| Water | 1.3 |
| Miscellaneous, such as dye, clay, perfume and enzymes | 2.8 |
| Total Parts | 100.00 |

Dissolution Test

A 3 g sample of both DETERGENT A and DETERGENT B were separately dispersed into 1 L aliquots of fresh tap water at 20° C., stirred at 200 RPM, using a magnetic stirrer and hotplate with thermocouple. The powders were left to dissolve for 30 seconds and then the dissolutions were decanted and passed through a cotton fabric filter (black cotton fabric, cut in a 9 cm diameter circle). The filters were dried and the mass of the dry filters were recorded before and after the filtration process. The initial and final weights were used to determine the % of undissolved detergent:

$$\%\ \text{undissolved detergent} = \frac{m_{filter\ after\ filtration} - m_{filter\ before\ filtration}}{3\ \text{g}} \times 100$$

The results can be seen in Table 5.

TABLE 5

| | % undissolved detergent |
|---|---|
| Powder Detergent A | 8.62% |
| Powder Detergent B | 5.49% |

As can be seen from Table 5, there was a 36% improvement in fast solubility in Detergent B as compared to Detergent A.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A spray-dried powder comprising:

(i) from about 20 to about 80 wt % of a first spray-dried particle comprising less than about 5 wt % sulphate, at least 45 wt % anionic detersive surfactant, silicate, and having a bulk density of from about 300 g/l to about 450 g/l; and (ii) from about 20 to about 80 wt % of a second spray-dried particle comprising at least about 55 wt % sulphate, from 0 to 10 wt % anionic detersive surfactant, and having a bulk density of from about 350 g/l to about 600 g/l;

wherein the spray-dried powder is essentially free of zeolite builder and of phosphate builder.

2. The spray-dried powder according to claim 1, wherein the first particle has a mean particle size of between about 350 μm and about 500 μm and the second particle has a mean particle size between about 350 μm and about 500 μm.

3. The spray-dried powder according to claim 2 wherein the first particle has a mean particle size of between about 375 μm and about 425 μm , and the second particle has a mean particle size between about 375 μm and about 425 μm.

4. The spray-dried powder according to claim 1, wherein the first particle, the second particle or both particles comprise polymer independently selected from a polycarboxylate homopolymer or a polycarboxylate copolymer.

5. The spray-dried powder according to claim 1 wherein the first particle, the second particle or both particles comprise a co-polymer comprising:

(i) from about 50 to less than about 98 wt % structural units derived from one or more monomers comprising carboxyl groups;

(ii) from about 1 to less than about 49 wt % structural units derived from one or more monomers comprising sulfonate moieties; and (iii) from about 1 to about 49 wt % structural units derived from one or more types of monomers selected from ether bond-containing monomers represented by formulas (I) and (II):

formula (I)

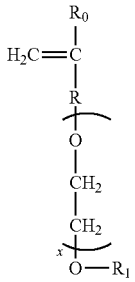

wherein in formula (I), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group;

formula (II)

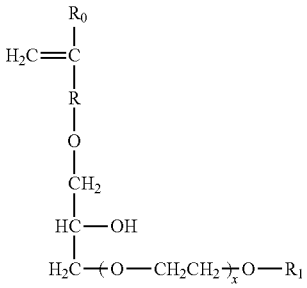

in formula (II), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

6. The spray-dried powder according to claim 1 wherein the first particle comprises from about 0 to about 5 wt % polymer.

7. The spray-dried powder according to claim 6 wherein the first particle comprises from about 1.5 to about 3 wt % polymer.

8. The spray-dried powder according to claim 1, wherein the anionic detersive surfactant in the first particle comprises linear alkylbenzene sulfonate.

9. The spray-dried powder according to claim 1, wherein the anionic detersive surfactant in the first particle comprises alkyl ethoxylated sulphate.

10. The spray-dried powder according to claim 1 wherein the first particle comprises HEDP, brighteners or a mixture thereof.

11. A laundry detergent composition comprising a spray-dried powder according to claim 1.

12. A process for making a spray-dried powder according to claim 1 comprising the steps of;

a) preparing a first aqueous slurry comprising the anionic detersive surfactant, the silicate and water;

b) preparing a second aqueous slurry comprising the sulphate and water;

c) spraying the first aqueous slurry through a first spray nozzle and the second aqueous slurry through a second spray nozzle into a spray-drying tower; and d) spray-drying the mixture to form the spray-dried powder.

13. The process according to claim 12, wherein the, silicate, the sulphate if present, and water are mixed together and then pumped along a pipe to the first spray nozzle, and wherein the anionic detersive surfactant is injected into the pipe before the first aqueous slurry is sprayed from the first spray nozzle.

14. The process according to claim 12, wherein the second aqueous slurry is prepared by mixing the sulphate, the water and if present the anionic detersive surfactant to form an aqueous premix, the aqueous premix is pumped through a pipe to the second spray nozzle [, if present the silicate and polymer are independently injected into the pipe before the spray nozzle].

15. The process according to claim 14, wherein the sulphate added to the second aqueous slurry has a volume average particle size of from about 10 micrometers to about 50 micrometers.

16. The process according to claim 15, wherein the sulphate added to the second aqueous slurry has a volume average particle size of from about 20 micrometers to about 50 micrometers.

17. The process according to claim 16, wherein the sulphate added to the second aqueous slurry has a volume average particle size of from about 30 micrometers to about 45 micrometers.

18. The process according to claim 17, wherein the sulphate added to the second aqueous slurry has a volume average particle size of from about 30 micrometers to about 42 micrometers.

19. The process according to claim 12, wherein the first spray nozzle is at a position higher up the spray drying tower than the second nozzle.

* * * * *